US006902031B2

(12) United States Patent
Ador

(10) Patent No.: US 6,902,031 B2
(45) Date of Patent: Jun. 7, 2005

(54) PERSONAL SAFETY DEVICE FOR A VERTICAL ROPE

(75) Inventor: Bernard R. Ador, Mandelieu (FR)

(73) Assignee: Capital Safety Group Emea, Cedex (FR)

( * ) Notice: Subject to any disclaimer, the term of this patent is extended or adjusted under 35 U.S.C. 154(b) by 0 days.

(21) Appl. No.: 10/023,485

(22) Filed: Oct. 30, 2001

(65) Prior Publication Data

US 2002/0112917 A1 Aug. 22, 2002

(30) Foreign Application Priority Data

Nov. 2, 2000 (FR) ..... 00 14075

(51) Int. Cl.[7] ..... A62B 1/16
(52) U.S. Cl. ..... 182/5; 182/192; 188/65.3
(58) Field of Search ..... 182/5, 192, 193; 188/65.1–65.4

(56) References Cited

U.S. PATENT DOCUMENTS

| | | | | | |
|---|---|---|---|---|---|
| 461,528 | A | * | 10/1891 | Fowler | 188/65.3 |
| 506,707 | A | * | 10/1893 | Matts | |
| 601,029 | A | * | 3/1898 | Weber | 188/65.3 |
| 2,085,319 | A | * | 6/1937 | Kolstedt | 188/65.2 |
| 2,976,955 | A | * | 3/1961 | Huber | 188/65.1 |
| 4,355,441 | A | * | 10/1982 | Hall | 24/134 KB |
| 4,580,658 | A | * | 4/1986 | Brda | 182/5 |
| 5,054,577 | A | * | 10/1991 | Petzl et al. | 182/5 |
| 5,597,052 | A | | 1/1997 | Rogleja | 188/65.5 |
| 6,446,753 | B1 | * | 9/2002 | Novak | 182/193 |

FOREIGN PATENT DOCUMENTS

| | | | |
|---|---|---|---|
| FR | 2 554 102 | | 5/1985 |
| FR | 2 626 184 | | 7/1989 |
| JP | 34598 | * | 3/1977 |
| WO | WO90/10476 | | 9/1990 |
| WO | WO95/06500 | | 3/1995 |

* cited by examiner

*Primary Examiner*—Alvin Chin-Shue
(74) *Attorney, Agent, or Firm*—IPLM Group, P.A.

(57) ABSTRACT

A safety device (100) includes a base (110), a handle (120) pivotally mounted on the base, a cleat (130) pivotally mounted on the base, and a cover (140) pivotally mounted on the base. A rope (99) is routed between the cleat and a bearing surface on the base, then between the cleat and a hub on the handle, then around the hub and between the hub and another bearing surface on the base, then between the cleat and the hub again. The handle may be squeezed against the base to control or limit descent along the rope, and in the event of excessively rapid descent, the device is urged toward a locked position relative to the rope.

19 Claims, 3 Drawing Sheets

PERSONAL SAFETY DEVICE FOR A VERTICAL ROPE

FIELD OF THE INVENTION

The present invention relates generally to a safety device suitable for interconnection between a person and a substantially vertical rope.

BACKGROUND OF THE INVENTION

Various types of safety devices are known in the art. One type of device, known as a descender, allows a person to descend along a vertical rope at a selectively variable speed. Another type of device, known as a rope grab, is movably connected to a rope and locks in place in the event that a person falls. The present invention is directed toward a safety device capable of function as both a descender and a rope grab.

SUMMARY OF THE INVENTION

A preferred embodiment of the present invention may be described as a combination descender and rope grab device. The device includes a base, a handle pivotally mounted on the base, and a cleat pivotally mounted on the base. A rope is routed downward into the device and along a first bearing surface on the base, then horizontally between the cleat and a second bearing surface on the base, then downward between the cleat and a hub on the handle, then around the handle hub and between the handle hub and a third bearing surface on the base, then downward between the cleat and the handle hub again, and then downward out of the device.

When a user squeezes the handle toward the base, the rope is compressed between the hub and the third bearing surface on the base. When the handle is released and/or moved to a middle position, the device accommodates downward descent along the rope. When the speed of descent exceeds a threshold amount, the handle is urged further away from the base plate, and the rope is compressed between the cleat and the handle hub and between the cleat and the second bearing surface on the base plate, as well.

A torsion spring may be interconnected between the handle and the base to bias the handle toward a desired orientation relative to the base. Also, a cover plate is preferably pivotally mounted on the base and pivotal between a closed position, spanning the portion of the rope routed as described above, and an open position, allowing an intermediate portion of the rope to be routed as described above. Various features and/or advantages of the present invention will become apparent from the more detailed description set forth below.

BRIEF DESCRIPTION OF THE DRAWINGS

With reference to the Drawings, wherein like reference numerals designate like parts and assemblies throughout the several views.

DETAILED DESCRIPTION OF THE PREFERRED EMBODIMENT

Figure 1:
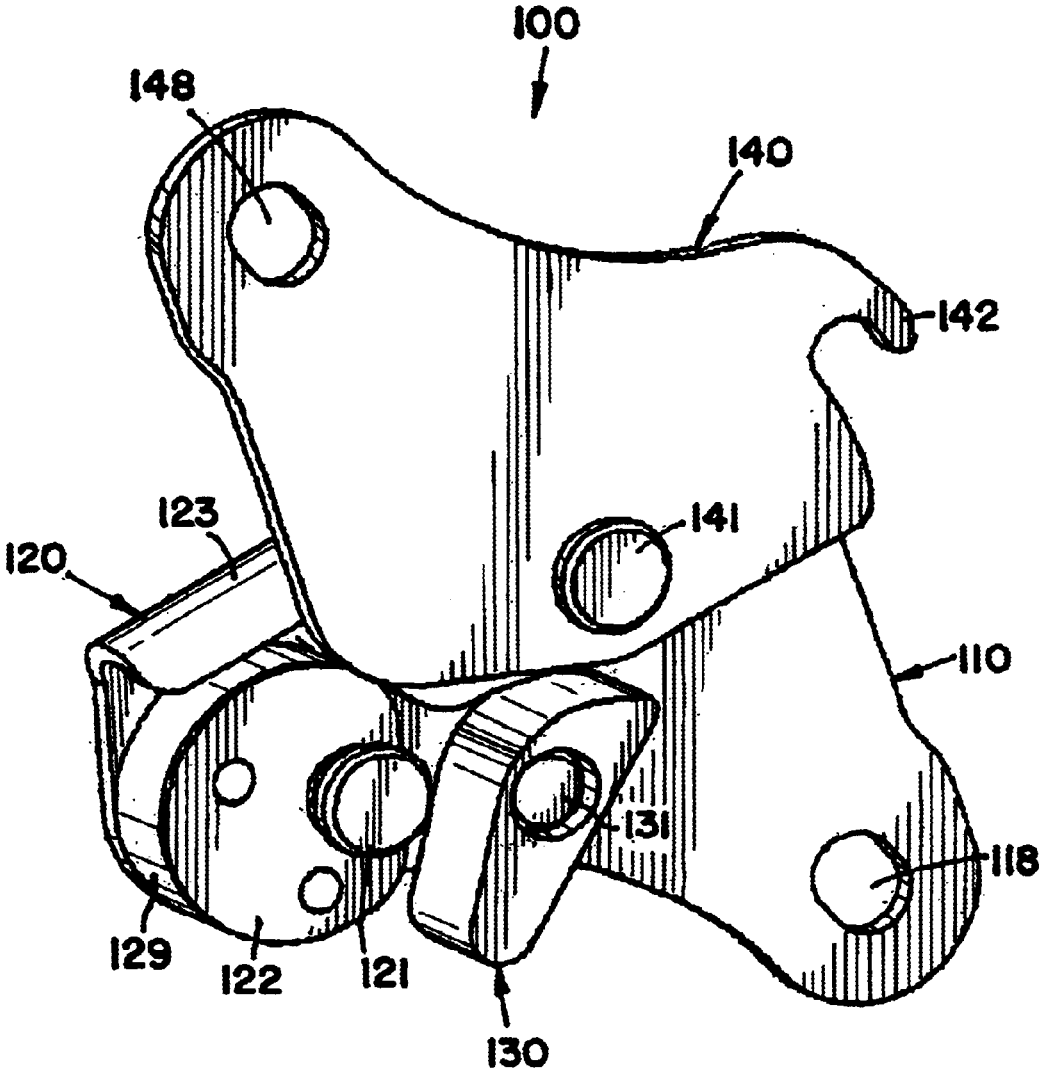
FIG. 1 is a perspective view of a preferred embodiment safety device in an open configuration.

A preferred embodiment safety device constructed according to the principles of the present invention is designated as 100 in FIGS. 1–4. The device 100 generally includes a base 110; a handle 120 pivotally mounted on the base 110 (by bolt 121); a cleat 130 pivotally mounted on the base 110 (by bolt 131); and a cover 140 pivotally mounted on the base 110 (by bolt 141).

The base 110 may be described in terms of a middle portion and opposite side portions. The handle 120 is pivotally mounted on one of the side portions of the base 110, and a hole 118 extends through the opposite side portion to receive a fastener, such as a carabiner or snap hook. The cleat 130 is pivotally mounted on the middle portion of the base 110, proximate a lower end thereof, and a boss 119 is mounted on the middle portion proximate an upper end thereof. The boss 119 is configured to provide a first bearing surface which faces generally toward the opening 118; a second bearing surface which faces generally toward the cleat 130; and a third bearing surface which faces generally toward the handle 120. Also, a hole 114 extends into the boss 119 to receive the bolt 141 for the cover 140.

The handle 120 may be described in terms of a hub 122 and a lever arm 123. The hub 122 may be described as a pulley or sheave having a perimeter which is three-fourths round and one-fourth flat. The hub 122 is eccentrically mounted on the bolt 121, with a central portion of the flat side nearest the bolt 121. The lever arm 123 extends away from the hub 122 in a direction generally parallel to the flat side of the hub 122, and then in a generally perpendicular direction toward the middle portion of the base 110. A distal portion of the lever arm 123 is rolled or folded to provide a comfortable, outwardly facing bearing surface. The lever arm 123 is pivotal to a position wherein a portion of the lever arm 123 parallels a portion of the boss 119 (as shown in FIGS. 2 and 4).

The cleat 130 may be described in terms of three portions which interface with the rope 99. A first, flat portion faces generally toward the hub 122; a second, flat portion faces generally toward the boss 119, and a third, rounded portion is disposed between the two flat portions.

The cover 140 may be described in terms similar to the base 110. In particular, a middle portion of the cover 140 is pivotally connected to the base 110 (by bolt 141); one side of the cover 140 is provided with a hook 142 sized and configured to fit about the shaft of the hub bolt 121 and to fit beneath the head of the hub bolt 121; and a hole 148 extends through an opposite side of the cover 140 and aligns with the hole in the base 110 when the hook 142 is engaged with hub bolt 121. A fastener, such as a carabiner or snap hook may be inserted through the aligned holes 148 and 118 to lock the device 100 in a closed position. As shown in FIG. 1, the fastener may be removed to facilitate attachment to or removal from the rope 99.

Figure 2:
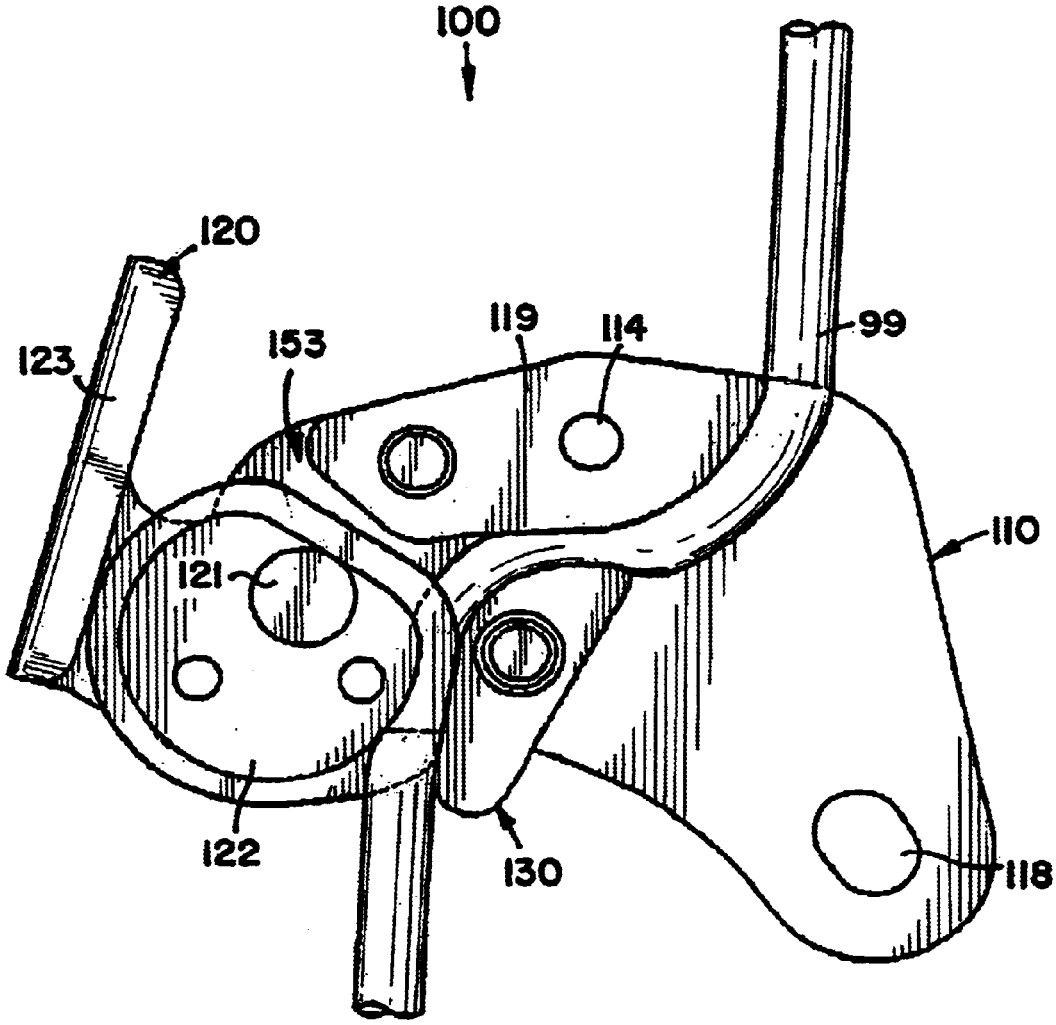
FIG. 2 is a side view of the safety device of FIG. 1 with a cover removed to show the safety device in a first locked configuration relative to a rope.
Figure 3:
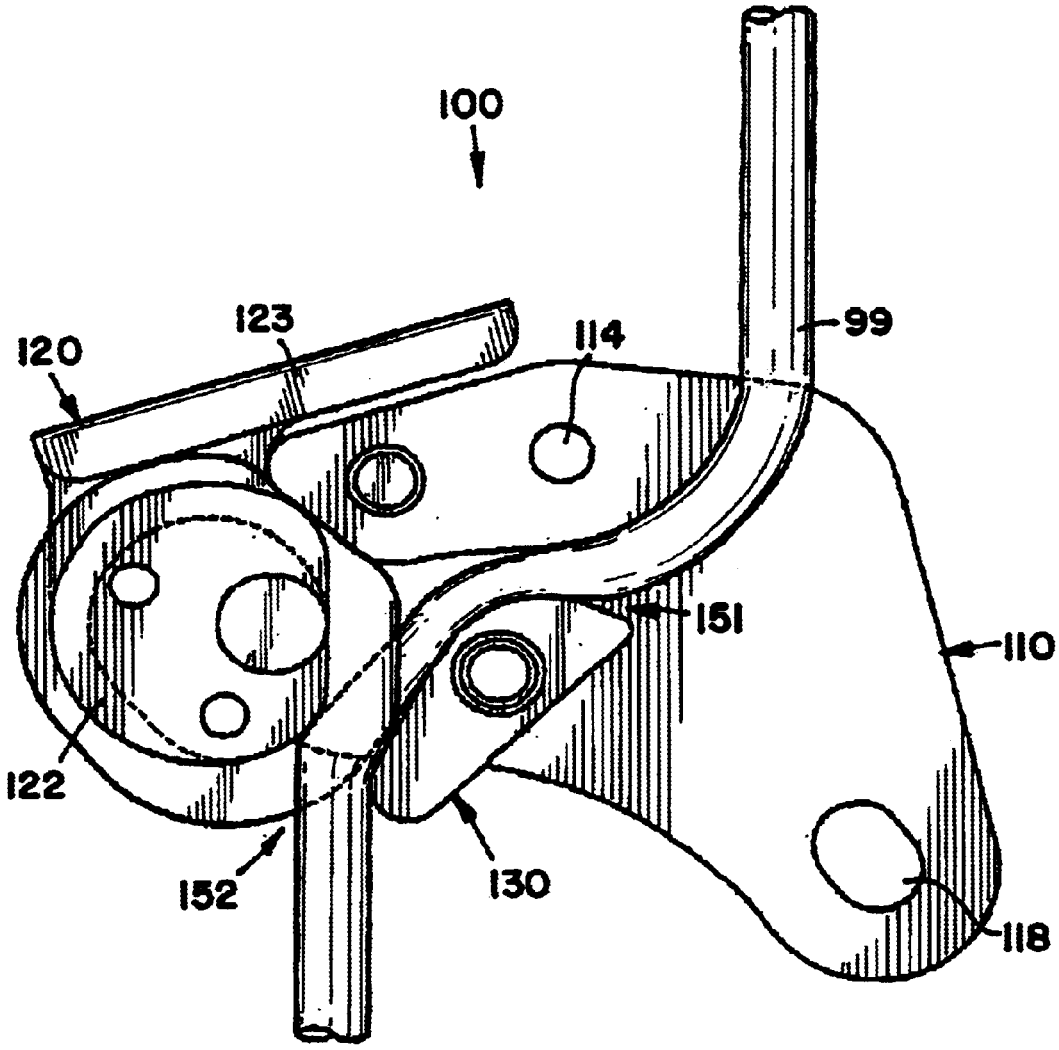
FIG. 3 is a side view of the safety device of FIG. 1 with a cover removed to show the safety device in a second locked configuration relative to a rope.

As shown in FIGS. 2–3, the rope 99 extends downward into the device 100; along the first bearing surface on the boss 199; horizontally between the cleat 130 and the second bearing surface on the boss 119; downward between the cleat 130 and a hub 122 on the handle 120; around the handle hub 122 and between the handle hub 122 and the third bearing surface on the boss 119; downward between the cleat 130 and the handle hub 122 again; and finally, downward out of the device 100.

FIG. 2 shows the handle 120 in an extreme counterclockwise orientation relative to the base 110. The device 100 assumes this configuration and locks onto the rope 100 in response to excessively fast descent along the rope 99 and the absence of user applied force against the handle 120. Under such circumstances, the opposing bearing surfaces on the hub 122 and the cleat 130 are encouraged to rotate in opposite directions and toward one another. The rope 99 is compressed or pinched between the hub 122 and the cleat 130 and between the cleat 130 and the second bearing surface on the boss 119.

FIG. 3 shows the handle 120 in an extreme clockwise orientation relative to the base 110. The device 100 assumes this configuration and locks onto the rope 100 in response to user applied force against the handle 120. Under such circumstances, the bearing surface on the hub 122 is rotated toward the opposing bearing surface on the boss 119. The rope 99 is compressed or pinched between the hub 122 and the boss 119.

When the handle 120 occupies an intermediate orientation relative to the base 110, the rope 99 is no longer compressed at any point, and thus, the device 110 is relatively free to move along the rope 99. Among other things, a torsional spring may be interconnected between the handle 120 and the base 110 to bias the handle toward this intermediate orientation, or any other desired orientation, relative to the base 110.

The present invention may also be described in terms of methods. For example, the present invention provides a method of securing a safety device relative to a rope, comprising the steps of: providing a base 110 with a bearing member 119; pivotally mounting a first member 130 on the base 110 in such a manner that the first member 130 and the bearing member 119 define a first gap therebetween (see 151 in FIG. 3); pivotally mounting a second member 120 on the base 110 in such a manner that the second member 120 and the first member 130 define a second gap therebetween (see 152 in FIG. 3), and the second member 120 and the bearing member 119 define a third gap therebetween (see 153 in FIG. 2); routing the rope 99 through the first gap 151, then through the second gap 152, then about the second member 120 and through the third gap 153, then through the second gap 152 again. The first member 130 is preferably pivotally mounted in eccentric fashion on the base 110, so the first gap 151 has a width that varies as a function of orientation of the first member 130 relative to the base 110; and the second member 120 is also preferably pivotally mounted in eccentric fashion on the base 110, so the third gap 153 has a width that varies as a function of orientation of the second member 120 relative to the base 110, and the second gap has a width that varies as a function of orientation of the first member relative to the base and/or orientation of the second member relative to the base.

The present invention has been described with reference to a preferred embodiment and a specific method. Recognizing that various alternatives, modifications, and/or applications are possible, and that this disclosure will enable persons skilled in the art to derive other embodiments and/or applications, the scope of the present invention is limited only to the extent of the claims that follow.

What is claimed is:

1. A method of securing a safety device relative to a rope, comprising:

providing a base;

pivotally mounting a handle on the base;

pivotally mounting a cleat on the base; and routing the rope into the device and through a first rope clamping space defined between the cleat and a bearing surface on the base, then through a second rope clamping space defined between the cleat and a hub on the handle, then around the hub and through a third rope clamping space defined between the hub and another bearing surface on the base, then through the second rope clamping space defined between the cleat and the hub, the rope going completely around the hub, wherein the rope overlaps itself, and then out of the device.

2. The method of claim 1, further comprising connecting a cover to the base, wherein the cover and a portion of the base are disposed on opposite sides of the handle, the cleat, and the rope.

3. The method of claim 2, wherein the cover is pivotally mounted on the base and pivots between an open position, providing access to respective gaps defined between the hub, the cleat, and the bearing surfaces on the base, and a closed position, spanning the gaps.

4. The method of claim 3, wherein respective openings in the cover and the base align to receive a fastener when the cover occupies the closed position.

5. The method of claim 4, wherein the handle and the base define a pivot axis, and the cleat is disposed between the pivot axis and the opening in the base.

6. The method of claim 1, wherein the hub is eccentrically mounted on the base.

7. The method of claim 6, wherein the hub is bounded by a perimeter having an arcuate portion and a straight portion, and the straight portion is most proximate a pivot axis defined between the hub and the base.

8. The method of claim 7, wherein the hub is configured like a sheave along the arcuate portion of its perimeter.

9. The method of claim 1, further comprising the step of pivoting the handle in a first direction to compress the rope between the hub and the base.

10. The method of claim 9, further comprising the step of pivoting the handle in an opposite, second direction to compress the rope between the hub and the cleat.

11. A method of securing a safety device relative to a rope, comprising the steps of:

providing a base with at least one bearing member;

pivotally mounting a first member on the base;

pivotally mounting a second member on the base;

routing the rope between the at least one bearing member and the first member, then between the first member and the second member, then about the second member and between the second member and the at least one bearing member, and then between the second member and the first member again, the rope going completely around the second member;

selectively compressing the rope between the first member and the at least one bearing member;

selectively compressing the rope between the second member and the at least one bearing member; and selectively compressing the rope between the first member and the second member.

12. A method of securing a safety device relative to a rope, comprising the steps of;

providing abase with at least one bearing member;

pivotally mounting a first member on the base in such a manner that the first member and the at least one bearing member define a first gap therebetween;

pivotally mounting a second member on the base in such a manner that the second member and the first member define a second gap therebetween, and the second member and the at least one bearing member define a third gap therebetween;

routing the rope through the first gap, then through the second gap, then about the second member and through the third gap, and then through the second gap again, the rope going completely around the second member;

compressing the rope between the first member and the at least one bearing member in response to pivoting of the first member in a first direction; and compressing the rope between the first member and the second member in response to pivoting of the first member in an opposite, second direction.

13. The method of claim 12, wherein the first member is pivotally mounted in eccentric fashion on the base, so the first gap has a width that varies as a function of orientation of the first member relative to the base.

14. The method of claim 13, wherein the second member is pivotally mounted in eccentric fashion on the base, so the third gap has a width that varies as a function of orientation of the second member relative to the base.

15. The method of claim 14, wherein the second gap has a width that varies as a function of both orientation of the first member relative to the base and orientation of the second member relative to the base.

16. The method of claim 12, wherein the second member is pivotally mounted in eccentric fashion on the base, so the third gap has a width that varies as a function of orientation of the second member relative to the base.

17. The method of claim 16, wherein the second gap also has a width that varies as a function of orientation of the second member relative to the base.

18. The method of claim 1, wherein the hub pivots in a first direction to compress the rope against the third bearing surface on the base, and the hub pivots in an opposite, second direction to compress the rope against the cleat.

19. The method of claim 11, wherein the rope is compressed between the first member and the at least one bearing member in response to pivoting of the first member in a first direction; and the rope is compressed between the first member and the second member in response to pivoting of the first member in an opposite, second direction.

* * * * *